US006176318B1

(12) United States Patent
Drakeley et al.

(10) Patent No.: US 6,176,318 B1
(45) Date of Patent: Jan. 23, 2001

(54) ACTUATOR APPARATUS AND METHOD FOR DOWNHOLE COMPLETION TOOLS

(75) Inventors: Brian Keith Drakeley; Albert Augustus Mullins, II, both of Humble; Richard M. Wilde, Spring, all of TX (US)

(73) Assignee: Halliburton Energy Services, Inc., Carrollton, TX (US)

( * ) Notice: Under 35 U.S.C. 154(b), the term of this patent shall be extended for 0 days.

(21) Appl. No.: 09/262,237

(22) Filed: Mar. 4, 1999

Related U.S. Application Data

(60) Provisional application No. 60/076,806, filed on Mar. 4, 1998.

(51) Int. Cl.[7] ..... E21B 23/00

(52) U.S. Cl. ..... 166/381; 166/66.4; 166/66.7; 166/237; 166/323

(58) Field of Search ..... 166/381, 66.4, 166/66.7, 65.1, 373, 386, 387, 316, 323, 179, 237

(56) References Cited

U.S. PATENT DOCUMENTS

| | | | |
|---|---|---|---|
| 3,373,817 | 3/1968 | Cubberly Jr., et al. | 166/66.4 |
| 3,830,306 | 8/1974 | Brown | 166/53 |
| 4,796,705 | 1/1989 | Carmody et al. | 166/323 |
| 4,838,355 | 6/1989 | Leismer et al. | 166/375 |
| 4,951,753 | 8/1990 | Eriksen | 166/375 |

*Primary Examiner*—Hoang Dang
(74) *Attorney, Agent, or Firm*—Haynes and Boone, LLP

(57) ABSTRACT

An actuator apparatus for actuating a downhole well tool according to which a housing extends in the well and a tool to be actuated is disposed in the housing. A drive member is connected to the tool for operating the tool, and an actuator system is disposed in the housing and is normally connected to the drive member for driving the drive member and operating the tool. In the event the actuator system fails, an additional actuator system is disposed in the housing and is adapted to be connected to the drive member for also driving the drive member and operating the tool.

25 Claims, 10 Drawing Sheets

ACTUATOR APPARATUS AND METHOD FOR DOWNHOLE COMPLETION TOOLS

CROSS-REFERENCE TO RELATED APPLICATION

This application is based on provisional application Ser. No. 60/076,806 filed on Mar. 4, 1998.

BACKGROUND

This disclosure relates generally to oil and gas well production and more particularly, to a actuator apparatus for downhole completion tools.

There are an abundance of well tools, such as valves, packers, chokes, etc. that are inserted downhole in an oil and gas well and are controlled from the ground surface to perform various functions such as, for example, controlling the flow of production fluid from a reservoir to a storage unit at the ground surface.

Failure of these type tools requires that the well be reentered to mechanically repair, adjust, or shift, the tool. This is very costly, and often poses environmental risks, especially in connection with a marine well such as a sub-sea well. Consequently, an important industry goal is to eliminate, or at least reduce or delay, the need for intervention.

Current systems use either electrical or hydraulic power to provide sufficient force to operate the well tools. Thus, a loss of fluid pressure in a hydraulically driven actuator, or a loss of electrical power to an electrically driven actuator, would at least temporarily, and perhaps permanently, disable all the tools that are actuated by that system, possibly requiring intervention.

Therefore, what is needed is a method and apparatus for increasing the reliability of well tools, and avoiding the limitations inherent in a single actuator system.

SUMMARY

Accordingly, an embodiment of the present invention is directed to a actuator apparatus for actuating a downhole well tool. To this end, an actuator system is provided that extends in the well along with the tool to be actuated. A drive member is connected to the tool to be actuated and the first actuator system is normally connected to the drive shaft for driving the drive member and operating the tool. An additional actuation system is disposed in the actuator housing and is adapted to be connected to the drive member for driving the drive member and operating the tool.

The present invention provides the distinct advantage of providing an alternate, or back-up actuation system in case the primary actuation system fails, thus considerably reducing the need for intervention and increasing the reliability of the downhole tool that is actuated.

DESCRIPTION OF THE PREFERRED EMBODIMENT

Figure 1:
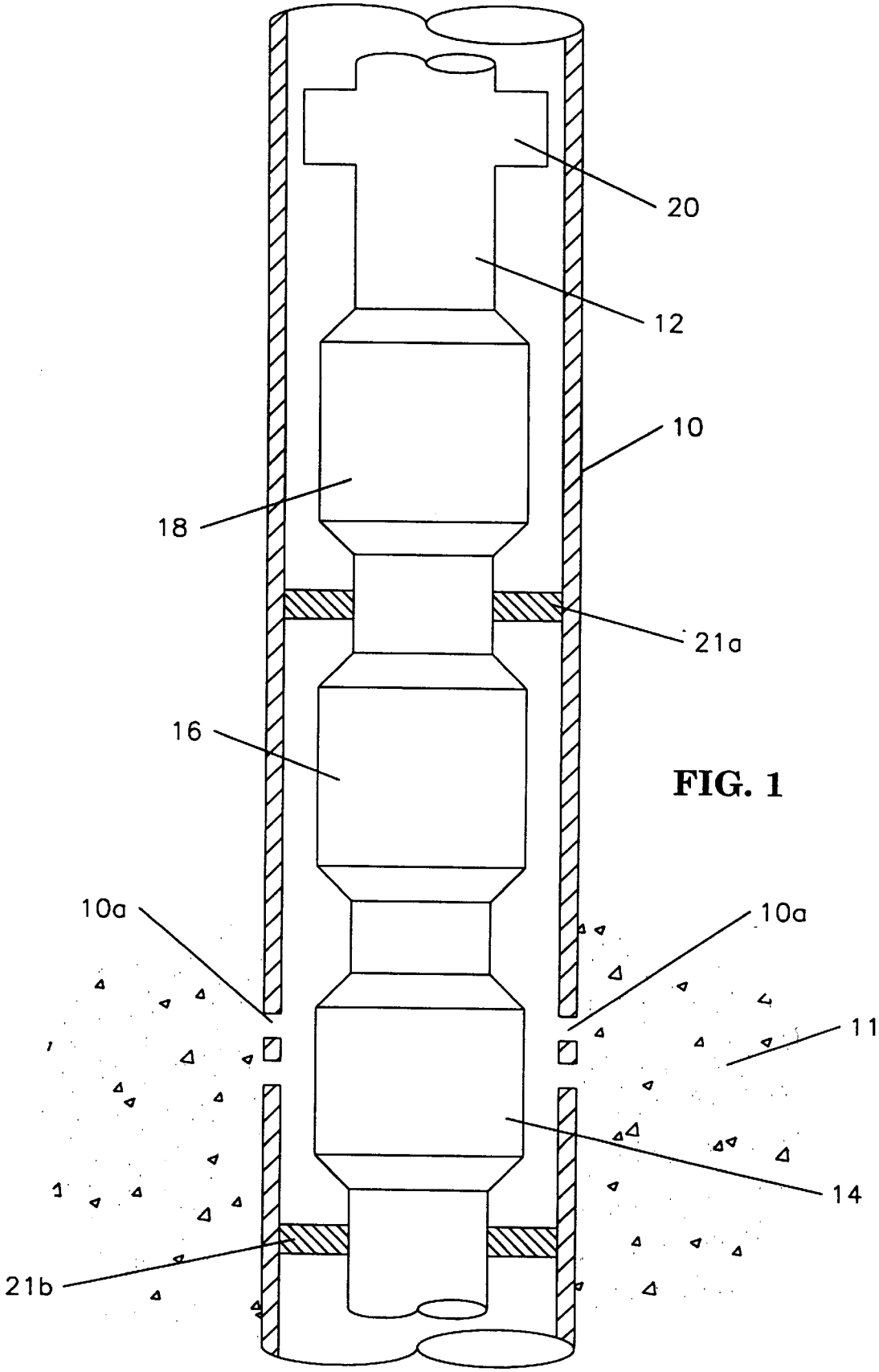
FIG. 1 is a schematic view depicting a flow control apparatus, including the actuator apparatus of an embodiment of the present invention, along with a flow control valve, connected in a tubing string disposed in a well casing.

Referring to FIG. 1 of the drawings, the reference numeral 10 refers, in general, to a casing that lines a borehole, or well, formed in the ground and extending from the surface of the ground to a reservoir 11 below the surface. The casing 10 has a plurality of perforations 10*a* formed therethrough to allow fluid, such as gas or oil, to flow from the reservoir 11 into the casing for return to the surface in a manner to be described.

A tubing string, shown in general by the reference numeral 12, is disposed in the casing and consists of a plurality of tubular segments, or housings, connected end-to-end in any know manner, such as by providing each housing with threaded end portions, so that adjacent housings can be connected together. Some of these housings will be described in detail.

A flow control apparatus is provided in the tubing string 12 and includes a flow control valve 14 connected in the lower portion of the tubing string located adjacent with the casing perforations 10*a*, and a actuator apparatus 16 connected in the tubing string just above the flow control valve 14 for actuating same in a manner to be described.

A standard sub-surface safety flow control valve 18 is also connected in the tubing string 12 between the actuator apparatus 16 and a tree system shown, in general, by the reference numeral 20. It is understood that the tree system 20 includes one or more ports, supply lines, connectors, hangers, and the like which are used in the standard production operations. Since the tree system 20 is conventional and does not form any part of the present invention, it will not be described in further.

The outer surfaces of the tubing string 12 are spaced from the inner surface of the casing 10 to define an elongated annular space. Two axially-spaced packer assemblies 21*a* and 21*b* extend in the latter space to define a zone extending from just above the actuator apparatus 16 to just below the flow control valve 14. This enables fluid from the formation 11 to be directed into the flow control valve 14 in a manner to be described. Other packers (not shown) can also be positioned in the annular space to define and isolate other zones in the space.

It is also understood that the tube segment extending below the flow control valve 14 can be connected to additional production tubing and other components in the tubing string 12, such as, for example, a flow meter, a tail pipe flow control device, a sand screen, and the like. Since the latter components, including the packer assemblies and 21*a* and 21*b*, are conventional and do not form any part of the present invention, they will not be described in detail.

Figure 2:
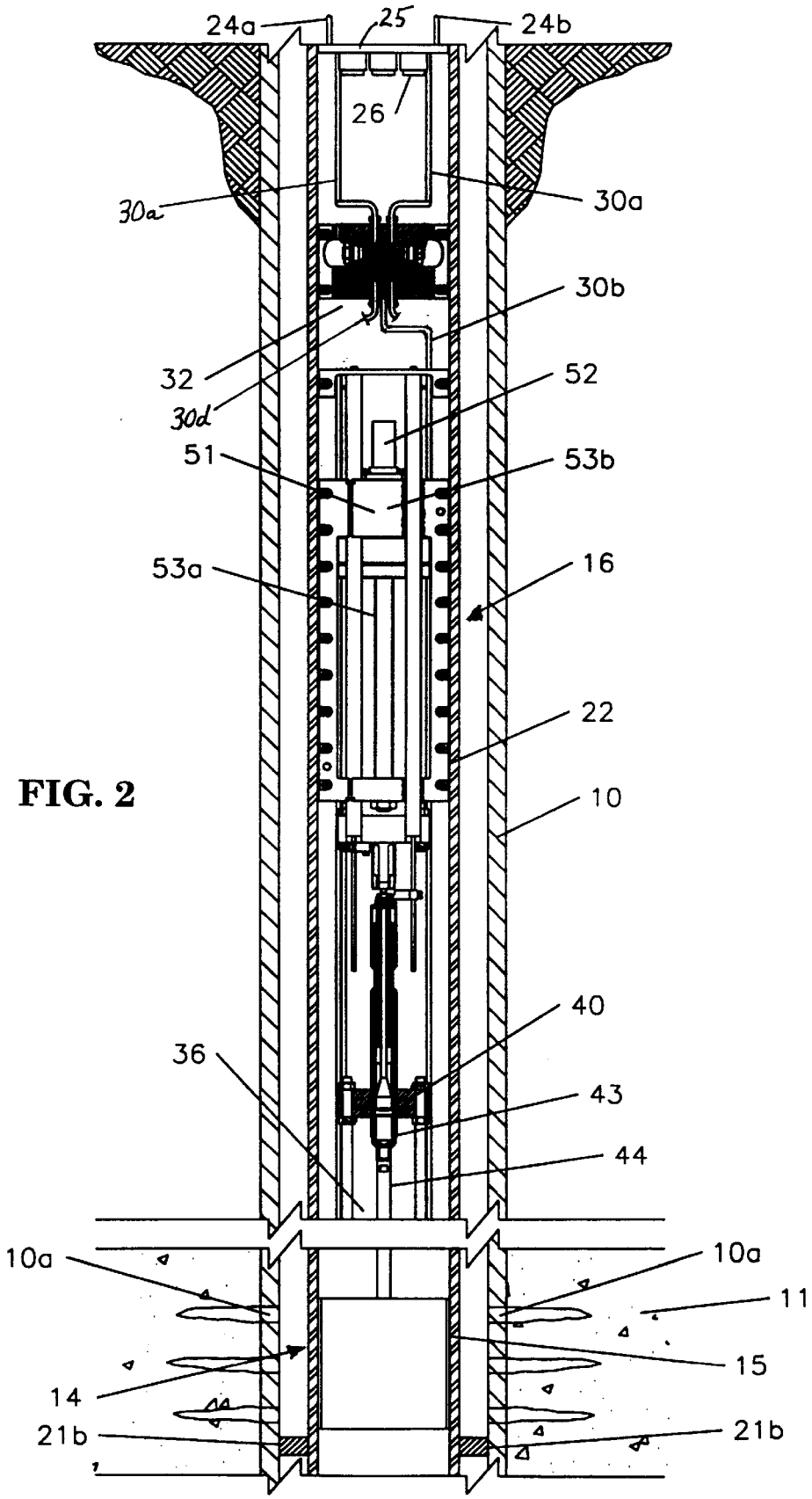
FIG. 2 is a cross-sectional view of the flow control apparatus of FIG. 1.

The flow control apparatus, including the flow control valve 14 and the actuator apparatus 16, are depicted in greater detail in FIG. 2, along with the corresponding portion of the casing 10.

The actuator apparatus 16 includes an elongated tubular actuator housing 22 connected in the tubing string 12 (FIG. 1). Two sleeves, or flatpacks, 24*a* and 24*b*, which contain hydraulic lines, as well as electrical and communication conductors, extend into the upper portion of the actuator housing 22. It is understood that the flatpacks 24*a* and 24*b*, including the lines and conductors, form an umbilical that extends from a controller (not shown) at the surface, down the exterior surface of the tubing string 12. The umbilical, including the above-mentioned lines and conductors, passes through an portion of the wall of the actuator housing 22 extending above that portion shown in FIG. 2, and the flatpacks 24*a* and 24*b* are connected to an interface 25 located in the actuator housing 22. The interface 25 functions to distribute some of the above-mentioned lines and conductors to components of the actuator apparatus 16 in a manner to be described.

A downhole electronics module 26 is disposed in the upper end portion of the actuator housing 22, receives the above-mentioned electrical conductors from the interface 25, and houses controls for the electronic components to be described.

Figure 3:
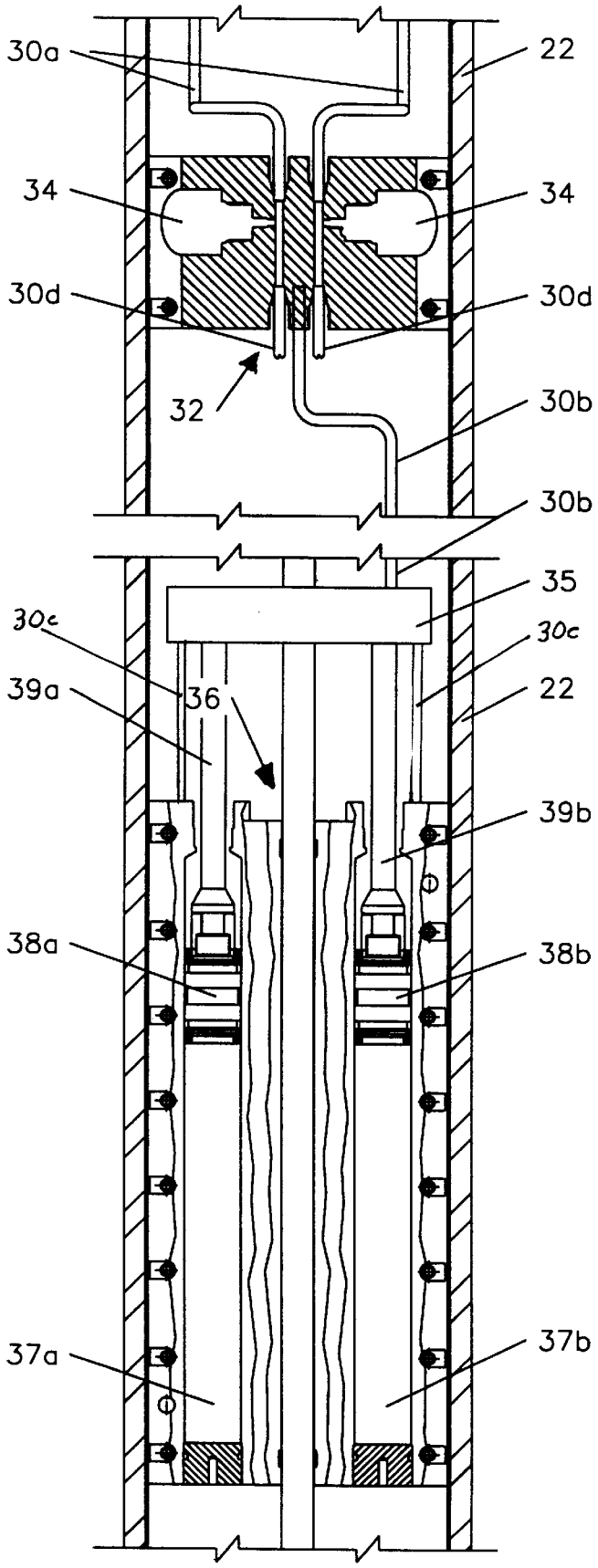
FIGS. 3–6 are enlarged cross-sectional views of the actuator apparatus of FIG. 1 depicting various sections of the apparatus.

Two hydraulic lines 30*a* respectively extend from the interface 25 to a hydraulic switching module 32 which is better shown in FIG. 3. The switching module 32 contains a pair of electrically powered solenoid flow control valves 34 for controlling the flow of fluid from the lines 30*a* through the module. A hydraulic line 30*b* extends from the switching module 32 to a hydraulic actuator control module 35 having a pair of solenoid flow control valves (not shown) for controlling the flow of fluid in a manner to be described. It is understood that the downhole electronics module 26 contains logic circuitry that controls the switching module 32 and the hydraulic actuator control module 35 so that the flow of hydraulic fluid is controlled in a manner to be described.

Two hydraulic lines 30*c* extend from the hydraulic actuator control module 35 to a hydraulic actuator system shown, in general by the reference numeral 36, and including two elongated hydraulic chambers 37*a* and 37*b*. Two pistons 38*a* and 38*b* are respectively disposed in the chambers 37*a* and 37*b* for reciprocal movement and are designed to form a seal with their corresponding chamber walls. It is understood that conventional charge and vent lines (not shown) are provided that register with the chambers 37*a* and 37*b*. The hydraulic actuator control module 35 selectively controls the flow of hydraulic fluid from the lines 30*c* into and from these charge and vent lines for driving the pistons 38*a* and 38*b* up and down in the chambers 37*a* and 37*b*, respectively, in a conventional manner under conditions to be described. A pair of hydraulic lines 30*d* (shown partially) extend from the switching module 32, and it is understood that they pass through the actuator housing 22 and along the outer surface of the flow control valve 14 (FIG. 2) for controlling additional completion tools (not shown) located downhole.

Figure 4:
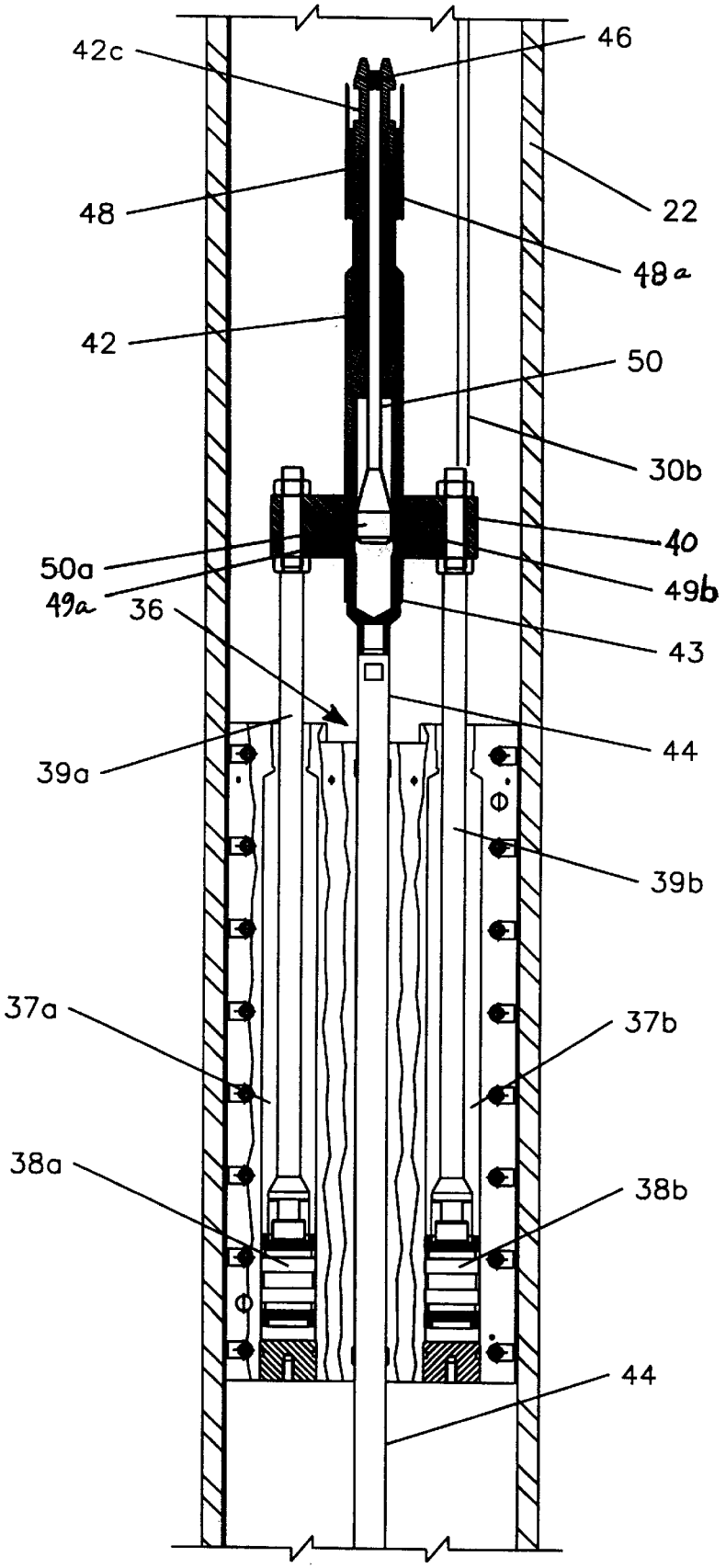

The pistons 38*a* and 38*b* are shown in their extended positions in the chamber 37*a* and 37*b*, respectively, in FIG. 3, and in their contracted positions in the chambers in FIG. 4. Two stems 39*a* and 39*b* are connected to, or formed integrally with, the pistons 38*a* and 38*b*, respectively, and extend axially from the pistons with their distal ends being connect to a coupling block 40 (FIG. 4).

Figure 5:
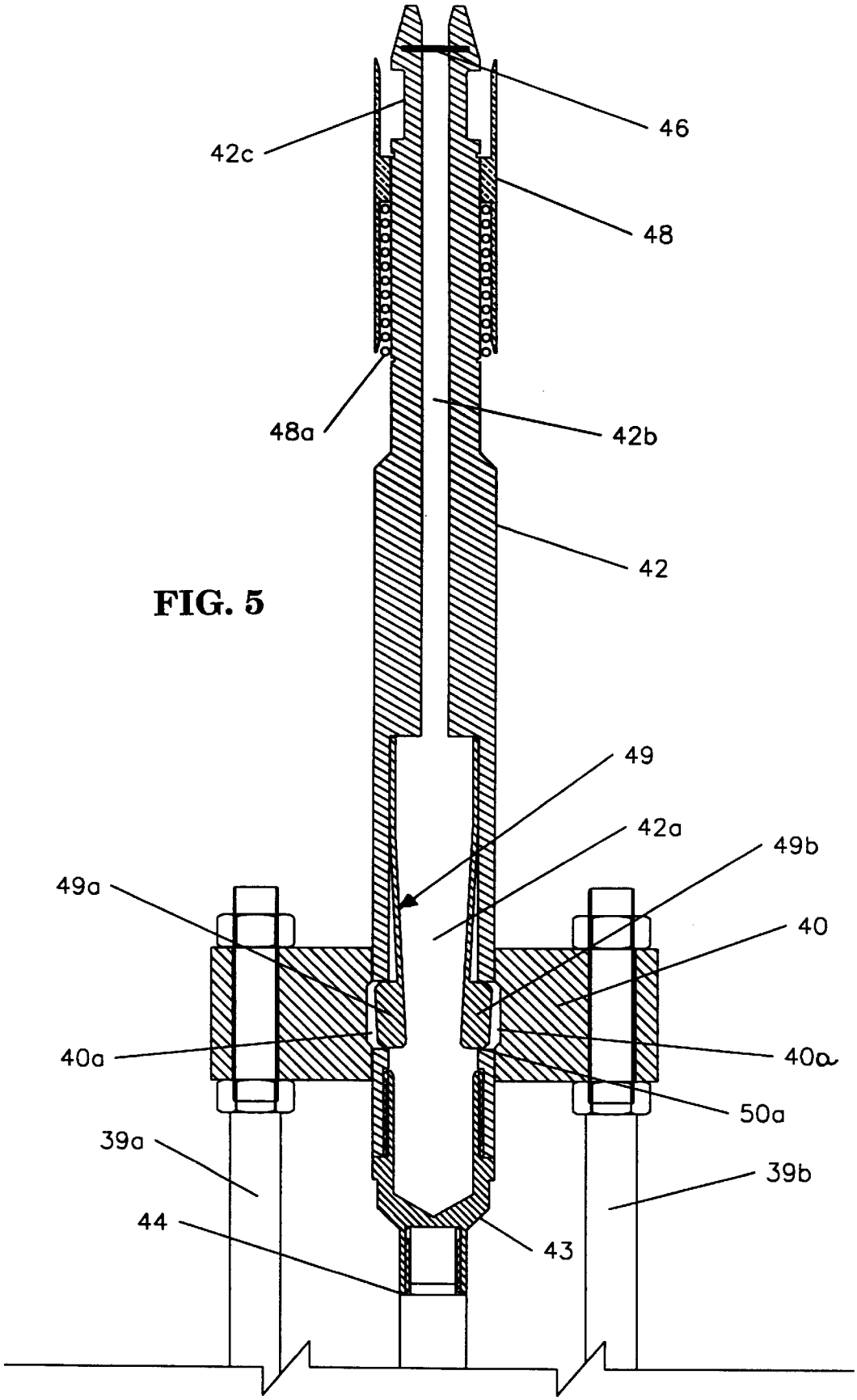

As better shown in FIG. 5, a transfer mechanism, in the form of a tailpiece 42, extends through a bore in the coupling block 40. The lower end of the tailpiece 42 is attached, by an adapter 43, to one end of a drive shaft 44. The drive shaft 44 extends through the remaining portion of the actuator housing 22 and to the flow control valve 14 (FIG. 2) and is coupled, at its other end, to a movable sleeve (not shown) in the flow control valve 14 to operate the valve in a manner to be described.

Two coaxial longitudinal bores 42*a* and 42*b* together extend for the length of the tailpiece, with the bore 42*a* having a greater diameter than the bore 42*b*. The upper end of the tailpiece 42 is tapered and an annular recess 42*c* is formed in the tailpiece 42 near the latter end. A radially-extending shear pin 46 extends across the upper end portion of the bore 42*b*. An annular capture sleeve 48 extends around the outer surface of the tailpiece 42 and around the annular recess 42*c*, and a spring 48*a* biases the sleeve 48 upwardly towards the tapered end of the tailpiece 42 for reasons to be described.

A key latch 49 is provided in the bore 42*a* of the tailpiece 42 near the other end of the tailpiece. The key latch 49 has two enlarged split end portions 49*a* and 49*b* which respectively extend through two diametrically opposed openings formed through that portion of the tailpiece 42 extending in the coupling block 40. The split end portions 49*a* and 49*b* are biased radially inwardly by their own inherent spring tension as shown in FIG. 5. These split end portions 49*a* and 49*b* are adapted to move radially outwardly under conditions to be described so as to extend through the latter openings in the tailpiece 42 and into an annular recess 40*a* formed in the coupling block 40.

As shown in FIG. 4, a rod 50, having an enlarged end portion 50*a*, extends through the bores 42*a* and 42*b* of the tailpiece 42. The end portion 50*a* is adapted to move to a position between the split end portions 49*a* and 49*b* of the key latch 49 as shown in FIG. 4 under conditions to be described. In this position, the end portion 50*a* bias the split end portions 49*a* and 49*b* into engagement with the annular recess 40*a* (FIG. 5), of the coupling block 40, to connect the tailpiece 42 to the coupling block. The rod 50 is not shown in FIG. 5 for the convenience of presentation.

With reference to FIG. 2, the flow control valve 14 may be of a conventional sliding sleeve design and, as such, includes a housing 15 adapted to be connected to the housing 22 and containing an inner sleeve (not shown) connected to the lower end of the drive shaft 44. It is understood that one or more radial openings are provided through the latter sleeve which are adapted to selectively register with corresponding openings (not shown) in the housing 15. This permits fluid from the formation 11 to pass through the perforations 10*a* in the casing, into the annular space between the housing 15 and the inner surface of the casing 10, and into the housing 15. The fluid then passes through a continuous bore defined through the control valve 14 and the remaining portion of the tubing string 12, including the actuator apparatus 16, and to the surface. The flow control valve 14 is normally positioned with the openings in the above-mentioned inner sleeve and the housing 15 out of registry to prevent the above flow; while axial movement of the flow control valve 14 in the housing by the drive shaft 44 causes the opening to register to permit the flow. Since the flow control valve 14 is conventional it will not be described in detail.

In operation of the hydraulic system 36, the solenoid flow control valves 34 (FIG. 3) of the hydraulic switching module 32 are opened by the above-mentioned logic system associated with the downhole electronics module 26. Hydraulic fluid thus passes from the surface, through the hydraulic lines 30*a* and to the switching module 32. The fluid is then passed from the switching module 32 to the actuator control module 35 via the hydraulic line 30*b*.

Referring to FIG. 4, the actuator control module 35 functions to selectively control the flow of fluid through the hydraulic lines 30*c* into and from the above-mentioned charge and vent lines connected to the two hydraulic chambers 37*a* and 37*b*. This forces the pistons 38*a* and 38*b*, their corresponding stems 39*a* and 39*b*, and therefore the coupling block 40, in an axial direction from the position shown in FIG. 4 to the position shown in FIG. 3.

It is noted that, during this movement of the coupling block 40, the enlarged end portion 50*a* of the rod 50 (FIG. 4) is positioned between the enlarged split end portions 49*a* and 49*b* to force them into the annular recess 40*a* of the block. This couples the tailpiece 42 to the block 40*b* for movement therewith. Thus, the drive shaft 44, and therefore the above-mentioned sleeve of the flow control valve 14 (FIG. 2), also move in an axial direction with the coupling block 40. The design is such that this movement causes the openings in the sleeve to register with the openings in the housing 15, as discussed above. This permits the flow of fluid into and through the flow control valve 14 and through the remaining portion of the tubing string 12, including the actuator apparatus 16, to the surface.

Figure 6:
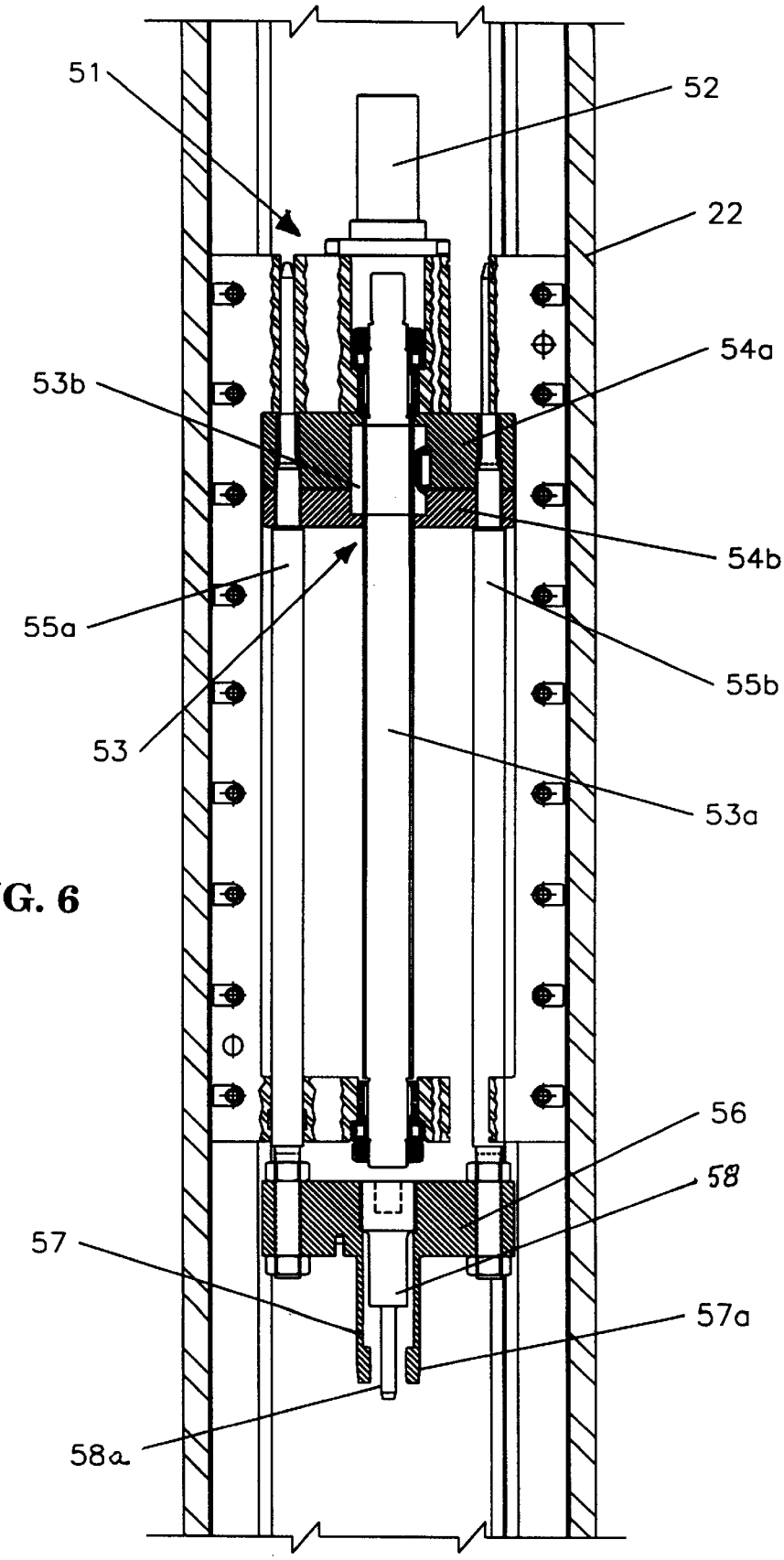

An electrical actuator system is shown, in general, by the reference numeral 51 in FIG. 6 and is for the purpose of providing an alternate system for actuating the flow control valve 14. The actuator system 51 includes a electric motor 52 mounted in the actuator housing 22 in any conventional manner, and connected to the downhole electronics module 26 by additional electrical conductors which are not shown for the convenience of presentation.

A nut and screw drive 53 is connected to the motor 52 and includes an externally threaded screw 53*a* (shown schematically) which is coupled to the output shaft (not shown) of the motor 52 for rotation therewith. A nut 53*b* is in threaded engagement with the screw so that, rotation of the screw 53*a* causes axial movement of the nut 53*b*.

A pair of guide blocks 54*a* and 54*b* are attached to the nut 53*b* for movement therewith, and a pair of guide rods 55*a* and 55*b* are coupled at one end to the guide blocks 54. Thus, the guide blocks 54, and therefore the guide rods 55, move axially with the nut 53*b* in response to actuation of the motor 52.

Figure 7A:
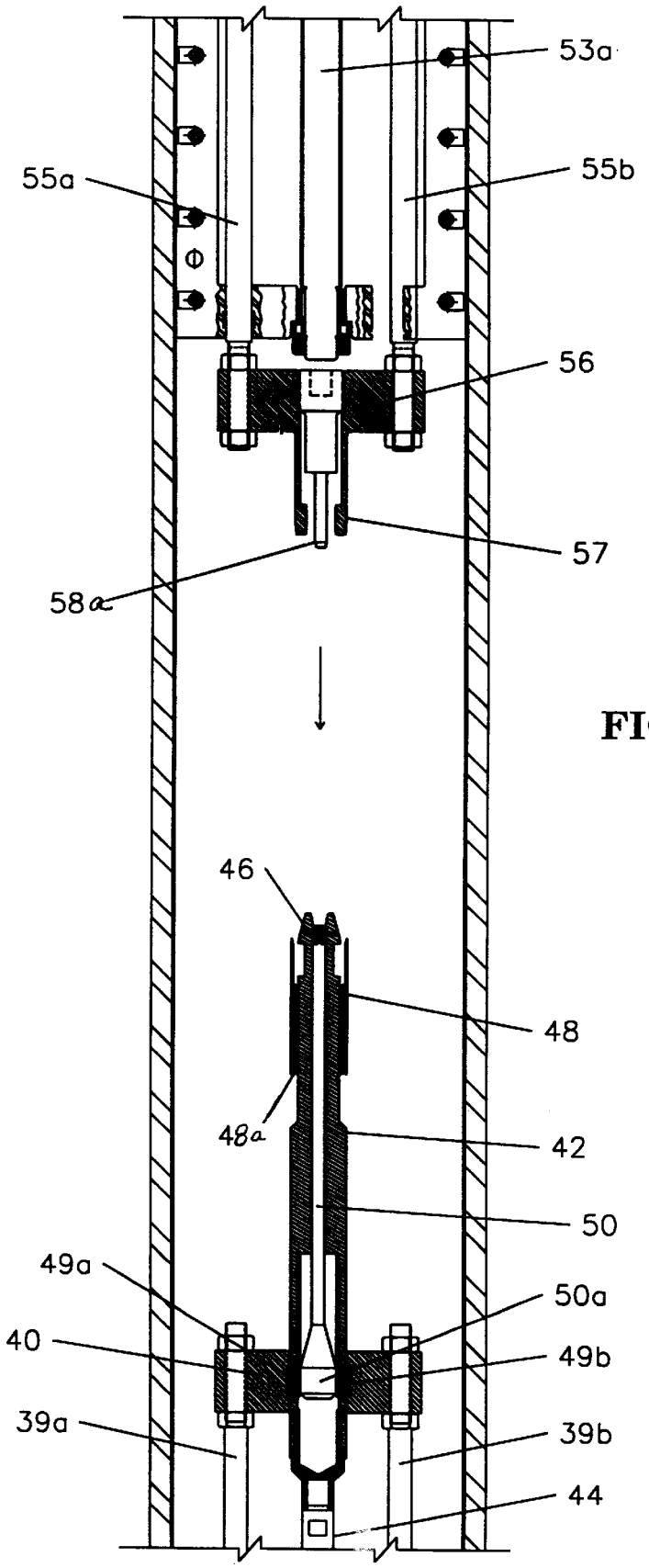
FIGS. 7A and 7B are cross-sectional views, depicting three operational modes of the actuator apparatus of FIGS. 2–6.

The other ends of the guide rods 55 are coupled to a T-shaped ram block 56 defining a longitudinal bore through the leg of the T. Four angularly-spaced collet fingers 57, two of which are shown in FIG. 6, extend from the lower surface of the block 56 and each collet finger has an enlarged distal end portion 57*a* for reasons to be described. A ram 58 is secured in the bore of the ram block 56, and has a reduced-diameter, distal end portion 58*a* that protrudes slightly past the collet fingers 57. When the hydraulic system 36 is in operation as discussed above, the ram 58 and collet fingers 57 are inactive as shown in FIG. 6, and do not engage any other component. However, when the hydraulic system 36 becomes inoperative such as when, for example, there is a loss of fluid pressure for whatever reason, then the motor 52 is activated to drive the nut 53*b* in an axial direction in the manner described above. This moves the guide blocks 54, the guide rods 55, and therefore the ram block 56 in an axial direction from the position of FIG. 7A to the position of FIG. 7B in which the ram 58 engages the tapered distal end of the tailpiece 42, as shown in FIG. 7B.

Figure 7B:
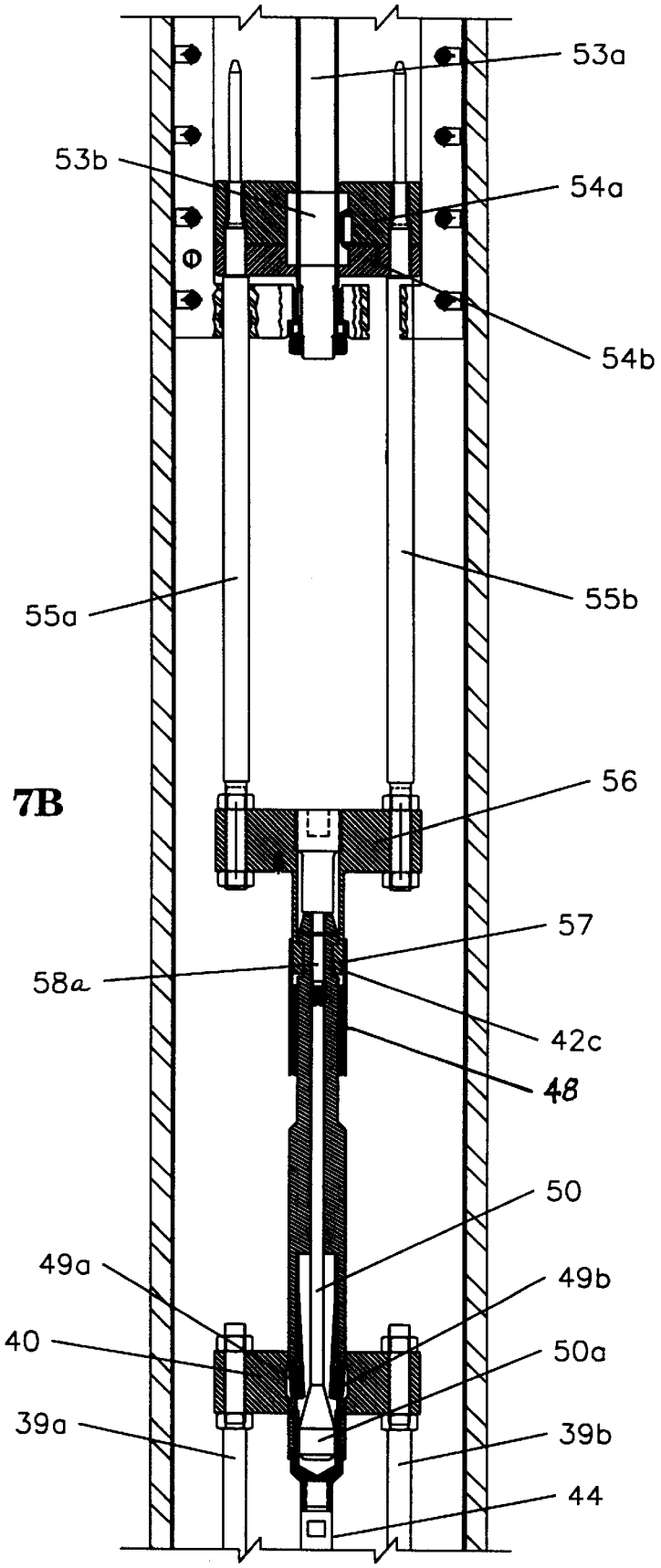
Figure 7C:
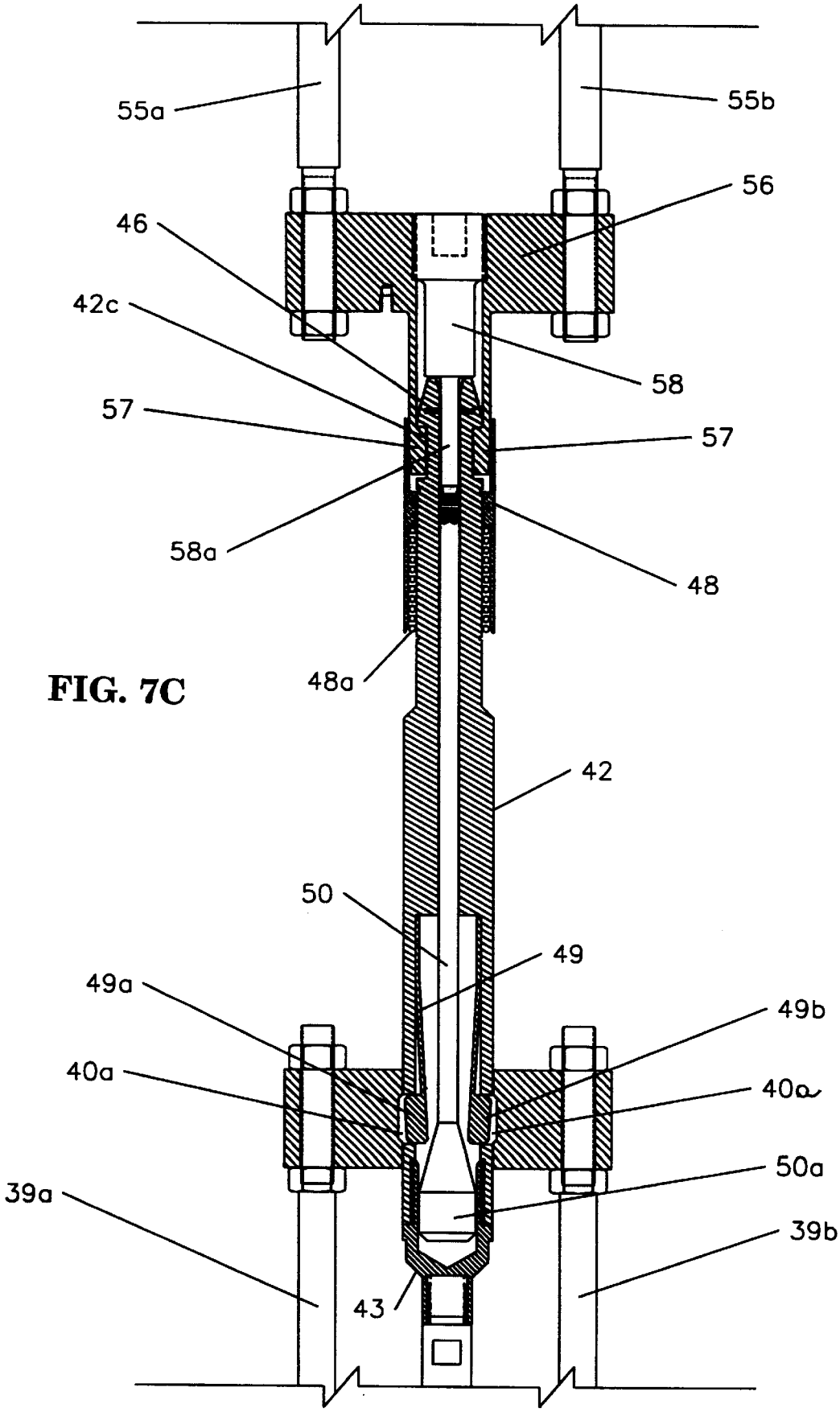
FIG. 7C is an enlarged cross-sectional view of a portion of the structure of FIG. 7B.

As better shown in FIG. 7C, the distal end portion 58*a* of the ram 58 is sized so as to extend in the bore in the distal end portion of the tailpiece 42. Thus, the end portion 58*a* initially enters the latter bore and continues to advance in an axial direction until it breaks the shear pin 46 and engages the upper end of the rod 50 and moves it axially in the tailpiece 42.

The enlarged end portion 50*a* of the rod 50 is thus moved from the position of 7A in which it engages the split end portions 49*a* and 49*b* of the key latch 49, to the position of FIGS. 7B and 7C in which it is out of engagement with the latter ends. Thus, the split end portions 49*a* and 49*b* move, under their spring tension, radially inwardly out of the annular recess 40*a* to decouple the tailpiece 42, and therefore the adapter 53 and the drive shaft 44 (FIG. 2), from the block 40. This effectively disengages the hydraulic system 36 from the flow control valve 14.

During this movement of the ram 58 into the bore of the tailpiece 42, the collet fingers 57 engage the tapered distal end of the tailpiece 42 and are biased slightly radially outwardly so that they engage the upper end of the capture sleeve 48 and force it downwardly against the bias of the spring 48*a*. This movement continues until the collet fingers 57 reach the annular recess 42*c* (better shown in FIG. 5) and flex radially inwardly into the recess as better shown in FIG. 7C. This allows the sleeve 48 to move up to its original position under the force of the spring 48*a*. The sleeve 48 thus locks the collet fingers 57 in place, thus locking the ram block 56 to the tailpiece 42, and therefore to the drive shaft 44. Thereafter, further movement of the nut 53*b* by the motor 52 results in a corresponding movement of the drive shaft 44, and therefore the above-mentioned sleeve of the flow control valve 14, in the same direction. Thus, the flow control valve 14 controls the flow of fluid into its housing 15 and through the remaining portion of the tubing string 12 (FIG. 1) as described above.

Figure 8:
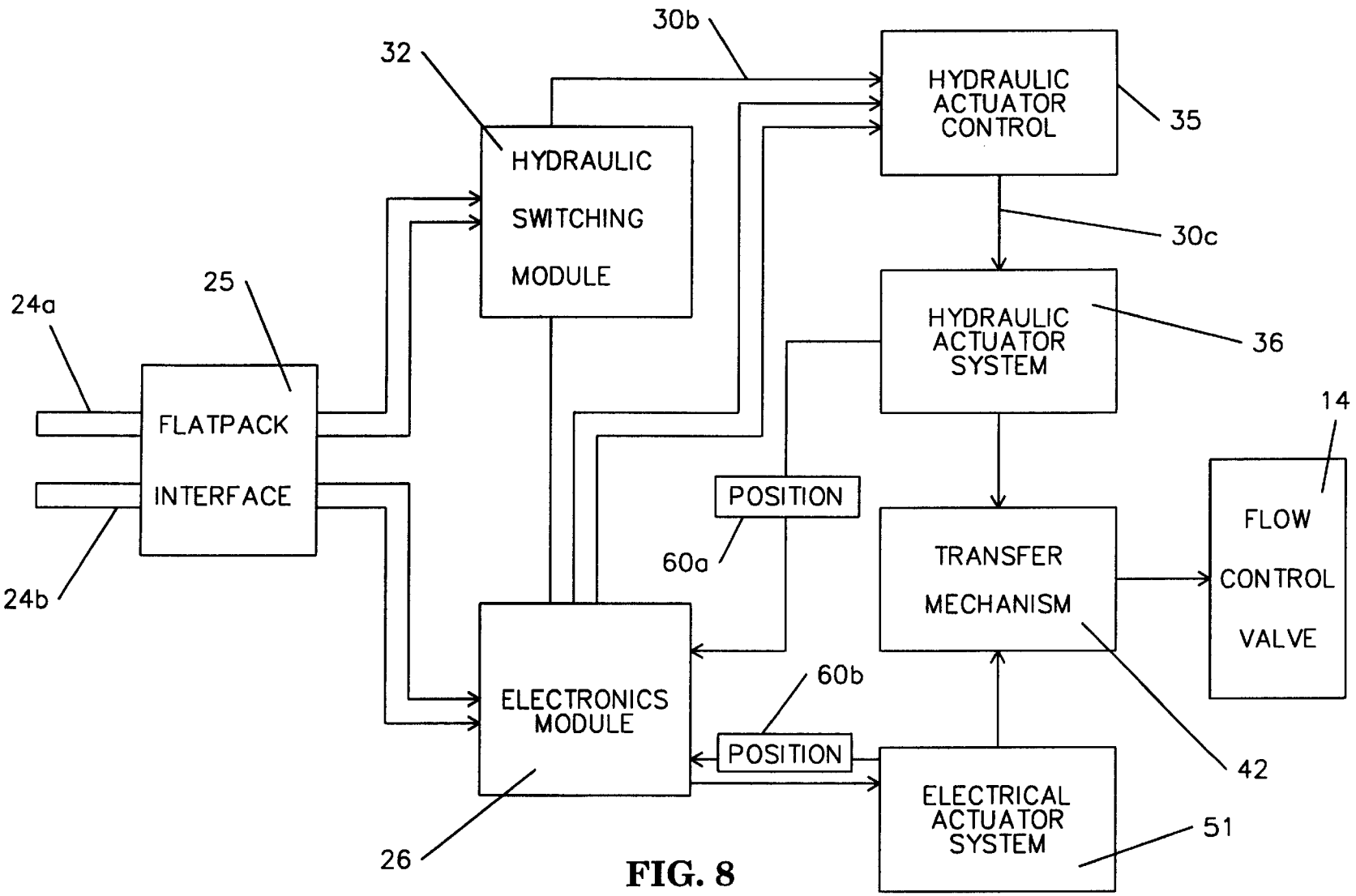
FIG. 8 is a flow diagram depicting the various electrical and hydraulic connections between the components of the apparatus of FIGS. 2–6.

The electrical and hydraulic flow diagram of FIG. 8 shows the electrical and hydraulic connections between the various components, as described above. It is noted that the downhole electronics module 26 is electrically connected to the electrical actuating system 51 to drive the motor 52, and therefore the nut and screw drive 53, in the manner described above. The downhole electronics module 26 is also electrically connected to the hydraulic actuator control module 35 to control the opening and closing of the above-mentioned charge and vent lines connected to the chambers 37*a* and 37*b* of the hydraulic actuator system 36 for controlling movement of the pistons 38*a* and 38*b*, respectively.

Two position sensors 60*a* and 60*b* are respectively connected to hydraulic actuator system 36 and to the electrical actuator system 51. The outputs of the sensors 60*a* and 60*b* are connected to the downhole electronics module 26 so that the module can control the operation of the systems 36 and 51 in the manner described above.

As also described above, the hydraulic actuator system 36 is normally used as the primary system to actuate the flow control valve 14. However, when the hydraulic actuator system 36 becomes inoperative such as when, for example, there is a loss of fluid pressure for whatever reason, then the electrical actuator system 51 is activated to control the flow control valve 14 in the manner described above. This, of course, offers the fundamental advantage of providing an alternate, or back-up, actuation system in case the primary actuation system fails, thus considerably reducing the need for intervention and increasing the reliability of the downhole tool that is actuated.

It is understood that, according to an alternate embodiment of the present invention, the actuator apparatus 16 of the above embodiment can be converted in a manner so that the electrical actuator system 51 is used as the primary actuator system in which case the hydraulic actuator system 36 would be used as the alternative, back-up system. According to this embodiment, the position of the tailpiece 42 would be reversed so that its tapered end portion faces in the opposite direction as shown in FIGS. 2,4, and 7A–7C so as to directly latch to the drive shaft 44. With a few minor exceptions, the design and function of the structure of this alternate embodiment is identical to that of the previous embodiment in which the hydraulic actuator system 36 is the primary actuation system. Since this conversion is well with the purview of a person skilled in this art, this alternative embodiment will not be described in any further detail.

It is also understood that an additional actuators identical to the actuators 36 and/or 51 can be provided in the housing 22 for operating the flow control valve 14, with the actuators being sequentially aligned along an axis and with a transfer mechanism extending between adjacent actuators. The actuators can be of different types, such as hydraulic or electric as discussed above, or of the same type.

It is also understood that if both of the above-described actuator systems 16 and 51 should fail, a mechanical shifting tool, run on coiled tubing or slick line, or used in association with a downhole power unit, would be used to shift the downhole tool to be actuated (which in the above embodiments is the flow control valve 14) to the desired position. Since this is also well within the purview of a person skilled in this art, it will not be described in any further detail.

Other variations may be made in the foregoing without departing from the scope of the invention. For example, the actuator apparatus 16 of the above embodiments can be used to actuate different downhole tools other than a flow control valve. Further, the hydraulic actuator system 36 does not necessarily have to be disconnected in order to operate the electrical actuation system 51. Also, additional packers can be provided to divide the well into several production zones as part of the well completion, in which case multiple actuator systems 36 and 51 would be provided along with corresponding downhole tools to control production from the various zones. Since other modifications, changes, and substitutions are intended in the foregoing disclosure, it is appropriate that the appended claims be construed broadly and in a manner consistent with the scope of the invention.

What is claimed is:

1. An actuator apparatus for use downhole in a well, the apparatus comprising a tubular member extending in the well, a tool disposed in the tubular member, a drive member connected to the tool for operating the tool, a coupling block disposed in the tubular member and adapted to be connected to the drive member for driving the drive member and operating the tool, a collet disposed in the tubular member and adapted to be connected to the drive member for driving the drive member and operating the tool, a latch normally connecting the coupling block to the drive member, a rod member, and a housing connected to the drive member and adapted to receive the rod member to permit slidable movement of the rod member in the housing to and from a position in which it unlatches the latch to disconnect the coupling block from the drive member, the housing having a recess formed on its outer surface for receiving the collet to connect the collet to the housing, and therefore to the drive member.

2. The apparatus of claim 1 wherein the drive member is moved linearly to operate the tool.

3. The apparatus of claim 2 wherein linear motion of the drive member operates the tool and further comprising a hydraulically actuated piston connected to the coupling block, and means for actuating the piston to move the coupling block when the drive member is connected to the coupling block to drive the drive member linearly to operate the tool.

4. The apparatus of claim 1 further comprising means for moving the collet axially into engagement with the housing, and a ram for moving the rod member axially in the housing to engage the latch to disconnect the coupling block from the latch, and therefore the drive member.

5. The apparatus of claim 4 wherein at least a portion of the ram extends in the housing to engage and move the rod member.

6. The apparatus of claim 1 wherein linear motion of the drive member operates the tool and wherein, after the engagement of the collet with the housing, and after the disconnection of the coupling block from the latch, the collet moves the drive member linearly to operate the tool.

7. The apparatus of claim 4 further comprising an electric motor, and means connecting the electric motor to the collet and the ram for moving the collet into the recess, the ram into engagement with the rod member, and the drive member linearly to operate the tool.

8. The apparatus of claim 1 wherein the coupling block is hydraulically operated and wherein the collet is electrically operated.

9. The apparatus of claim 8 further comprising means for connecting the coupling block to a source of hydraulic fluid located above ground, and means for connecting the collet to an electrical power source above ground.

10. The apparatus of claim 1 wherein the tool is a flow control valve and wherein the drive member moves linearly to selectively open and close the valve.

11. An actuator apparatus for use downhole in a well, the apparatus comprising a housing extending in the well, a tool disposed in the housing, a drive member connected to the tool for operating the tool, a hydraulically operated actuator system disposed in the housing and adapted to be connected to the drive member for driving the drive member and operating the tool, and an electrically operated actuator system disposed in the housing and adapted to be connected to the drive member for driving the drive member and operating the tool.

12. The apparatus of claim 11 further comprising means for connecting the hydraulically-operated actuator system to a source of hydraulic fluid located above ground, and means for connecting the second actuator system to an electrical power source above ground.

13. The apparatus of claim 11 wherein the tool is a flow control valve and wherein the drive member moves linearly to selectively open and close the valve.

14. A method for actuating a downhole tool comprising:

connecting a drive member to the tool, connecting a transfer mechanism to the drive member, connecting a coupling block to the drive member through the transfer system, connecting a piston to the coupling block, hydraulically actuating the piston for moving the coupling block and driving the drive member for operating the tool, and actuating a second actuator system for disconnecting the coupling block from the drive member, and then moving collet fingers on the second actuator system into a recess formed on the transfer mechanism to connect the second actuation system to the transfer mechanism and therefore to the drive member for driving the tool.

15. The method of claim 14 wherein linear motion of the drive member operates the tool and wherein the coupling block and the second actuator system are adapted to move the drive member linearly.

16. The method of claim 14 wherein the collet fingers are moved by connecting a electric motor to the collet fingers to move the collet fingers, and therefore the drive member, in a linear direction to operate the tool.

17. An actuator apparatus for use downhole in a well, the apparatus comprising a housing extending in the well, a tool disposed in the housing, a drive member connected to the tool for operating the tool, and a plurality of actuator systems axially aligned in the housing and adapted to be independently and selectively connected to the drive member for driving the drive member and operating the tool.

18. The apparatus of claim 17 further comprising a transfer mechanism adapted to connect one of the actuator systems to the drive member and being response to the activation of another actuator system for disconnecting the one actuator system from the drive member and connecting the other actuator system to the drive member.

19. The apparatus of claim 17 wherein linear motion of the drive member operates the tool and wherein each of the actuator systems is adapted to move the drive member linearly.

20. The apparatus of claim 17 wherein at least one of the actuator systems is hydraulically operated and wherein at least one other of the actuator systems is electrically operated.

21. The apparatus of claim 17 wherein the drive member is moved linearly to operate the tool.

22. An actuator apparatus for use downhole in a well, the apparatus comprising a housing extending in the well, a tool disposed in the housing, a drive member connected to the tool for operating the tool, and a plurality of actuator systems disposed in the housing and adapted to be selectively connected to the drive member for driving the drive member and operating the tool, at least one of the actuator systems being hydraulically operated and at least one other of the actuator systems being electrically operated.

23. The apparatus of claim 22 wherein the actuator systems are axially aligned in the housing.

24. The apparatus of claim 22 wherein the drive member is moved linearly to operate the tool.

25. The apparatus of claim 22 wherein the actuator systems are adapted to be independently connected to the drive member.

* * * * *